United States Patent [19]

Nurczyk

[11] Patent Number: 4,928,750

[45] Date of Patent: May 29, 1990

[54] VAV VALVE WITH PWM HOT WATER COIL

[75] Inventor: Mark E. Nurczyk, Eastman, Wis.

[73] Assignee: American Standard Inc., New York, N.Y.

[21] Appl. No.: 257,566

[22] Filed: Oct. 14, 1988

[51] Int. Cl.[5] ..... F24F 11/053; F24F 11/06; F25B 29/00

[52] U.S. Cl. ..... 165/2; 165/16; 165/22; 165/26; 165/27; 236/49.3; 236/46 F; 236/1 B; 236/1 C; 251/129.05

[58] Field of Search ..... 165/16, 22, 26, 27, 165/28, 30, 39; 62/90, 173; 236/1 B, 1 C, 46 F, 49.3; 251/129.05

[56] References Cited

U.S. PATENT DOCUMENTS

| | | | |
|---|---|---|---|
| 3,593,645 | 7/1971 | Day | 98/40 |
| 3,650,318 | 3/1972 | Avery | 165/22 |
| 3,680,469 | 8/1972 | Vandermey | 98/41 |
| 4,189,093 | 2/1980 | Schnaibel et al. | 236/37 |
| 4,258,877 | 3/1981 | White | 236/49.3 |
| 4,294,403 | 10/1981 | Ammons et al. | 236/13 |
| 4,328,926 | 5/1982 | Hall, Jr. | 236/49.3 |
| 4,346,838 | 8/1982 | Mayo | 236/46 |
| 4,420,113 | 12/1983 | Lacroix | 236/1 |
| 4,546,795 | 10/1985 | Okamoto et al. | 251/129.05 |
| 4,548,355 | 10/1985 | Stolz et al. | 237/12.3 B |
| 4,694,890 | 9/1987 | Zarate | 236/46 F |
| 4,766,921 | 8/1988 | Williams | 251/129.05 |
| 4,830,274 | 5/1989 | Johnson et al. | 236/49.3 |
| 4,838,483 | 6/1989 | Nurczyk et al. | 236/49.3 |

FOREIGN PATENT DOCUMENTS

| | | | |
|---|---|---|---|
| 2222616 | 10/1974 | France | 236/46 F |
| 2329012 | 5/1977 | France | 236/46 F |

*Primary Examiner*—John Ford

*Attorney, Agent, or Firm*—William J. Beres; Robert J. Harter; William O'Driscoll

[57] ABSTRACT

A refrigeration system for temperature conditioning several comfort zones includes several VAV (variable air volume) valves each having a hot water coil conveying water whose flow rate is regulated by a PWM (pulse-width modulated) solenoid valve. Each VAV valve is connected to a supply air duct conveying cool supply air. When a zone's temperature is above a set point temperature, the opening of the VAV valve is modulated to meet the cooling demand, and the water coil is shut off. When a zone's temperature is below the set point, the VAV valve is opened to provide a predetermined constant airflow rate and the hot water coil's solenoid valve is cycled open and closed in a pulse-width modulated manner to meet the heating demand.

11 Claims, 2 Drawing Sheets

VAV VALVE WITH PWM HOT WATER COIL

TECHNICAL FIELD

This invention generally pertains to the temperature conditioning of a plurality of comfort zones using a plurality of variable air volume valves and more specifically pertains to reheating a cool supply airflow to meet a heating demand.

BACKGROUND OF THE INVENTION

Many refrigeration systems can provide a variable supply of cooled air to cool multi-zone buildings. The amount of cooled air conveyed to each zone is often regulated by valves to meet each zone's cooling demand. Valves used for such a purpose are commonly referred to in the industry as VAV (variable air volume) valves.

A problem exists when one or just a few zones require heating while the rest of the zones still require cooling. Simply shutting off the cool supply air to these few zones is an unsatisfactory solution to the problem, because each zone requires at least some ventilation. Providing each zone with an additional supply air duct for heating is another possible solution, but one which is very expensive, especially when retrofitting an existing structure.

SUMMARY OF THE INVENTION

To avoid the problems associated with present VAV systems, it is an object of the invention to independently temperature condition a plurality of comfort zones by heating some zones while cooling others by selectively reheating portions of a common supply of cool air prior to conveying the supply air to the zones.

Another object of the invention is to coordinate the positioning of a VAV valve and the cycling of a solenoid valve.

Another object of the invention is to coordinate the positioning of a VAV valve and the cycling of a solenoid valve in response to a temperature sensor and an airflow sensor.

Yet another object of the invention is to regulate the average flow rate of a hot fluid using a simple open-closed control scheme.

A further object of the invention is to vary the duty cycle of a PWM solenoid valve as a function of a temperature error plus the length of time the error exists.

A still further object of the invention is to vary the cycling rate of a PWM solenoid valve to minimize temperature fluctuations during periods of low heating demands by increasing the cycling rate, and to minimize valve wear during periods of Another object of the invention is to provide a constant, non-varying airflow rate of variable temperature when heating and to provide a variable airflow rate of a constant, non-varying temperature when cooling.

Yet another object of the invention is to provide a VAV valve assembly with an attached fan and check valve to assist in warming a relatively cool supply airflow.

These and other objects of the invention are accomplished by a novel VAV assembly. The assembly includes an airflow valve for regulating the flow rate of a relatively cool supply airflow to be delivered to a comfort zone. The assembly also includes a hot fluid coil that, when needed, reheats the cool supply air. The average flow rate of fluid through the coil is regulated by cycling the valve open and closed in a PWM manner. When the temperature of the zone is above its set point temperature, the solenoid valve remains closed and the opening of the airflow valve is regulated to meet the zone's cooling demand. When the temperature of the zone is below its set point temperature, the solenoid valve is cycled with a variable duty cycle to meet the zone's heating demand and the airflow valve is controlled to provide a substantially constant airflow rate.

DESCRIPTION OF THE PREFERRED EMBODIMENT

Figure 1:
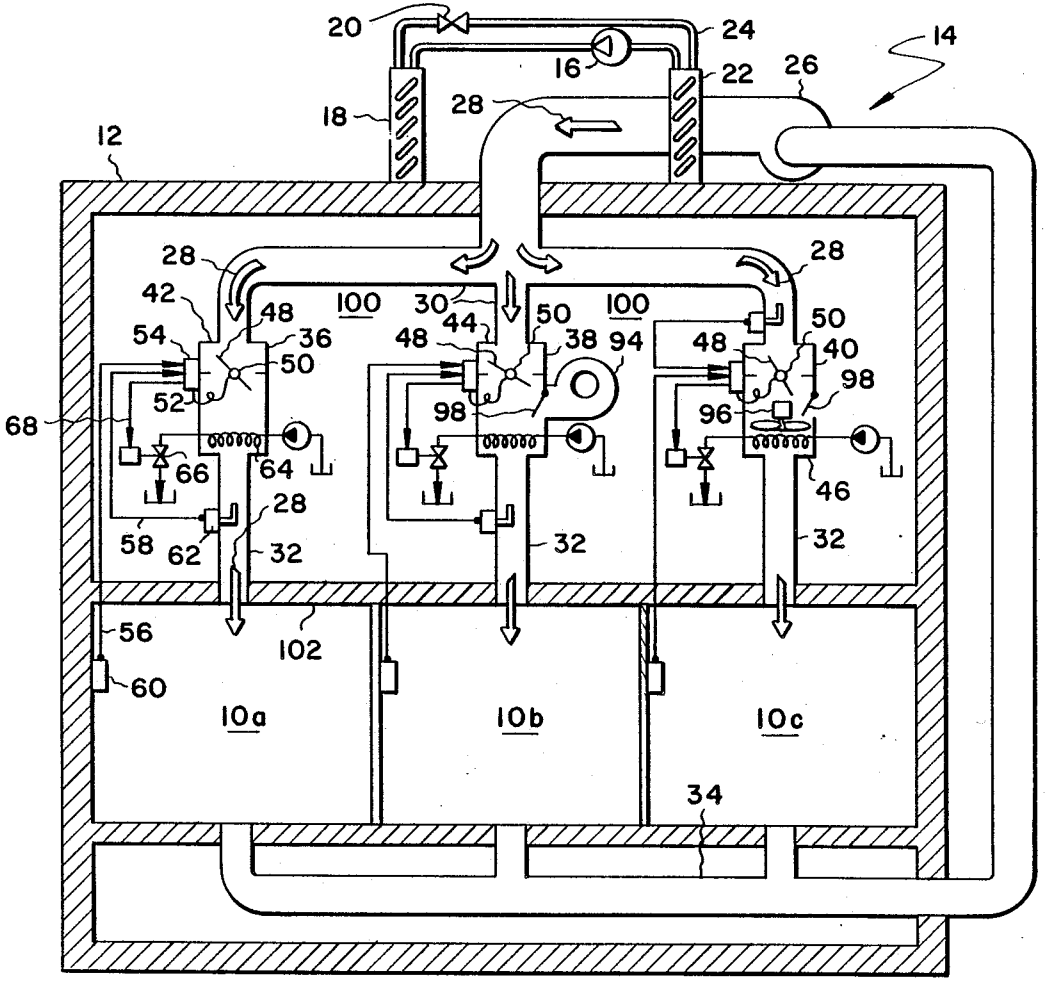
FIG. 1 illustrates the subject invention used for temperature conditioning a plurality of comfort zones.

Referring to FIG. 1, several comfort zones 10*a*, 10*b*, and 10*c* within a building 12 are temperature conditioned by a refrigeration system 14. A refrigerant compressor 16, a condenser 18, an expansion device 20, and an evaporator 22 are connected in series to comprise a closed-loop refrigeration circuit 24. Evaporator 22 and an evaporator fan 26 serve as a source of supply airflow 28 to zones 10*a*, 10*b*, and 10*c*. Evaporator 22 cools supply airflow 28 to a temperature that is generally below the temperature of comfort zones 10*a*, 10*b*, and 10*c*.

Supply airflow 28 is distributed to zones 10*a*, 10*b*, and 10*c* by way of a supply air duct network means 30 comprising a plurality of supply air ducts 32 connected to each zone. A return air duct network 34 conveys air from these zones and returns it back to evaporator fan 26 for recirculation through the system.

Each zone 10*a*, 10*b*, and 10*c* is associated with a VAV valve 36, 38, and 40 that regulates the rate at which supply air 28 is delivered each zone. Each VAV valve assembly 36, 38, and 40 includes a valve body 42, 44, and 46 connected to a supply air duct 32.

Valves 36, 38, and 40 have several similar features so a description of their operation will be made with reference only to zone 10*a* and its associated VAV valve 36, keeping in mind that the description applies to valves 38 and 40 as well.

VAV valve 36 includes a moveable closing member 48 disposed within valve body 42. Closing member 48 is repositioned by a drive means 50. The variable positions of closing member 48 determines the flow rate of supply airflow 28 passing through valve 36. Closing member 48 is schematically illustrated as a rotatable damper blade; however, member 48 represents any device that can vary the flow rate of air such as a plug valve of linear movement (e.g., the valves of U.S. Pat. Nos. 4,749,000 and 4,749,001 specifically incorporated by reference herein), a gate-type valve, or even an inflatable bladder. Drive means 50 represents any device for varying the position of member 48. Few examples of drive means 50 include motors, cylinders, and diaphragms.

Drive 50 modulates the position of VAV valve 36 under the control of a command signal 52 provided by a microcomputer based control means 54. Control means 54 relies on an internally stored algorithm to generate command signal 52 in response to a temperature feedback signal 56 and a flow rate feedback signal 58. The specific design of control means 54 can vary widely, depending on the specific input and output devices employed (items 50, 60, 62, and 66 which are further explained below) It should also be appreciated that microcomputer based control means 54 can be replaced entirely by discrete electronic components.

The temperature feedback signal 56 is provided by a temperature sensor 60 associated with the same zone 10*a* that is associated with VAV valve 36. The temperature feedback signal 56 indicates the error between a selectable desired set point temperature of zone 10*a* and the actual temperature of zone 10 *a* as measured by temperature sensor 60. Flow rate feedback signal 58 is provided by a flow sensor 62 which senses the flow rate of supply air 28 leaving VAV valve 36. Flow rate sensor means 62 represents any device for sensing airflow, such as a Pitot tube. It should be noted that in addition to or as an alternative, sensor 62 can be connected upstream of VAV valve 36 (as is the case with valve 40) to measure the rate of airflow entering valve 36.

When the temperature of zone 10*a* exceeds the set point temperature, control 54 commands drive 50 to open valve 36 to an extent that will provide an airflow rate which meets the cooling demand. The desired rate of airflow, and thus the valve position, is a function of the temperature error and the length of time the error exists (e.g., porportional plus integral control). Control 54 uses flow rate feedback signal 58 to ensure that the commanded valve position actually results in the desired rate of airflow. If desired, control 54 may further adjust the position of closing member 48 to minimize the difference between the actual rate of airflow and the desired rate of airflow. The position of closing member 48 is adjusted to reduce the error between the zone temperature and its set point.

If the temperature of zone 10*a* drops below a set point temperature, valve 36 is still held partially open to provide at least some airflow 28 for adequate ventilation. However, to prevent zone 10*a* from getting uncomfortably cold, a heating coil 64 is employed within valve body 42. Coil 64 conveys a heated fluid, such as water and/or glycol, that is sufficiently warm to heat airflow 28 to a temperature greater than that of comfort zone 10*a*.

The extent to which airflow 28 is heated by coil 64 is controlled by a solenoid valve 66 connected in series with heating coil 64. Solenoid valve 66 is cycled open and closed in a pulse-width modulated manner to meet the heating demand of the comfort zone. The cycling of solenoid valve 66 is controlled by a command signal 68 generated by control 54 in response to the zone temperature error and, if desired, in further response to the length of time that the error exists.

Figure 2:
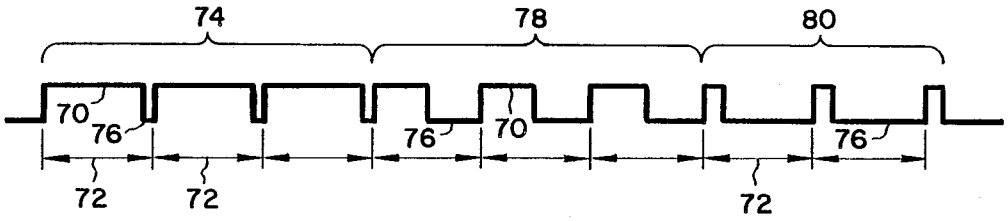
FIG. 2 is a PWM signal controlling a solenoid valve with the signal having a constant frequency.

Referring to FIG. 2, in one embodiment of the invention, solenoid valve 66 is cycled at a relatively constant frequency with a variable open-period 70 within each cycle 72. FIG. 2 illustrates a cycle period 72 of three minutes, or in other words, the frequency is once every three minutes. The percentage of open-period 70 within each cycle period 72 is referred to as duty cycle. The duty cycle increases with the heating demand. Region 74 represents a 90 % duty cycle to meet a relatively high heating demand. With a 90 % duty cycle, valve 36 has an open-period 70 of 162 seconds and a closed-period 76 of 18 seconds during a total cycle period 72 of three minutes. Region 80 represents a 20 % duty cycle to meet a relatively low heating demand, and Region 78 represents a 50 % duty cycle.

While coil 64 is being used to reheat airflow 28, closing member 48 of VAV valve 36 is positioned to provide a relatively constant flow rate to satisfy minimum ventilation requirements. This can be accomplished by generally holding closing member 48 at (or just below) a fixed predetermined position. For greater control, the position of closing member 48 can be modulated in response to the flow rate feedback signal 58 to ensure a constant flow rate.

Figure 3:
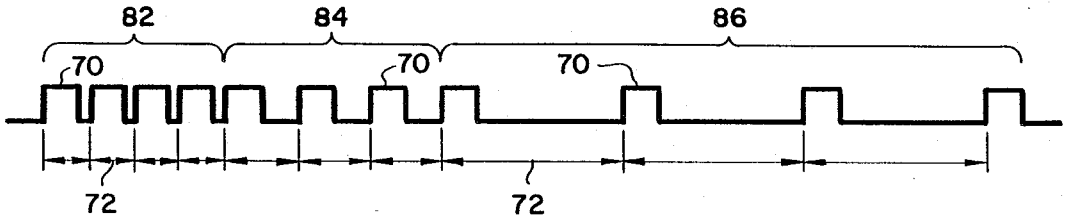
FIG. 3 is a PWM signal controlling a solenoid valve with the-signal having a lower frequency at lower duty cycles.

In another embodiment of the invention, referring to FIG. 3, the duty cycle is varied to meet the demand by maintaining a constant open-period 70 while varying cycle period 72. Open-period 70 is set to allow sufficient time for a complete exchange of fluid within coil 64. Region 82 represents a 90 % duty cycle, region 84 represents a 50 % duty cycle, and region 86 represents an 80 % duty cycle.

Figure 4:
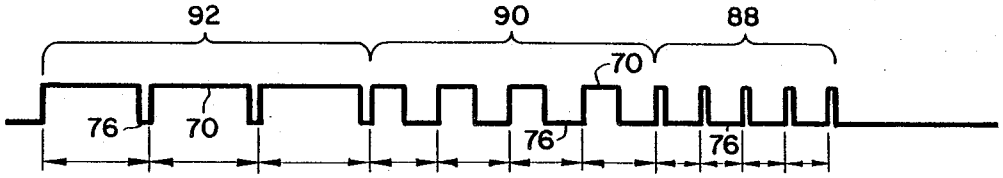
FIG. 4 is a PWM signal controlling a solenoid valve with the signal having a higher frequency at lower duty cycles.

In yet another embodiment of the invention, referring to FIG. 4, the frequencies vary to limit closed-period 76 to less than a predetermined maximum. Excessively long closed-period 76 between open-period 70 can cause uncomfortable temperature fluctuations of airflow 28. These fluctuations are minimized by increasing the cycle frequency at lower duty cycles, such as in region 88 where the duty cycle is 10 %. Region 90 represents a duty cycle of 50 %, and region 92 represents a duty cycle of 80 %.

Referring back to FIG. 1, to conserve energy in meeting a heating demand fan means 94 or 96 and check valve means 98 can be added to VAV valve assemblies 36, 38, and/or 40, check valve means 98 represents any device that provides greater flow resistance in one direction than n an opposite direction. Ideally, the flow will be substantially blocked in one direction and relatively unrestricted in the other direction. Fan means 94 and 96 represent any device for delivering kinetic energy to air such as an axial or centrifugal fan. Fan 94 is mounted outside of valve body 44 and discharges ambient air 100 into it. As an alternative, fan means 96 is disposed entirely within valve body 46 and draws ambient air 100 into valve body 46. Ambient air 100, as referred to herein, is the air surrounding any valve body 42, 44, or 46. Valve bodies 42, 44, and 46 and the surrounding ambient air 100 are generally above a ceiling 102 of a comfort zone where the air temperature is generally higher than that of the comfort zone. Thus the relatively warm ambient air 100 can assist in warming an uncomfortably cool comfort zone. Check valve means 98 is located downstream of closing member 48 and prevents cooled supply air 28 from discharging into ambient air 100. With internally mounted fan means 96, check valve means 98 can be eliminated by operating fan 96 at a sufficiently high speed that would ensure that the air pressure between closing member 48 and fan 96 is less than the ambient air pressure.

Although the invention is described with respect to a preferred embodiment, modifications thereto will be apparent to those skilled in the art. Therefore, the scope of the invention is to be determined by reference to the claims which follow.

I claim:

1. A VAV valve assembly comprising:

a temperature sensor associated with a comfort zone;

a valve body adapted to be connected in series with a supply air duct conveying airflow to said comfort zone, said airflow being at a temperature below a zone temperature of said comfort zone as sensed by said temperature sensor;

a moveable closing member disposed inside said valve body and having a variable position that varies the flow rate of said airflow;

control means for generating at least one command signal in response to said temperature sensor;

drive means coupled to said closing member for varying said variable position of said closing member in response to said at least one command signal, whereby the flow rate of said airflow varies as a function of zone temperature;

fan means connected to said valve body for drawing ambient air into said valve body and discharging said ambient air into said comfort zone, said valve body being at a higher elevation than said comfort zone so that said ambient air tends to be warmer than said comfort zone;

a coil connected to said valve body and adapted to convey a fluid through said valve body to heat said airflow and said ambient air to a temperature greater than said zone temperature; and a solenoid valve connected in series with said coil to control the flow of said fluid through said coil in response to said at least one command signal such that said solenoid valve remains substantially closed when said closing member is open beyond a predetermined position and such that said solenoid valve cycles between fully open and closed in a pulse-width modulated manner with a duty cycle that varies in response to said at least one command signal when said closing member is open no further than said predetermined position, said duty cycle having a predetermined maximum closed-period to avoid uncomfortable temperature fluctuations of said airflow.

2. The VAV assembly as recited in claim 1, further comprising a flow sensor means for providing said control means with a flow rate feedback signal indicating the actual rate of airflow through said VAV valve, said at least one command signal varying in response to said flow rate feedback signal.

3. The VAV valve assembly as recited in claim 1, wherein said solenoid valve cycles at a variable frequency that increases as said duty cycle decreases.

4. The VAV valve assembly as recited in claim 1, wherein said duty cycle varies as a function of an error between said zone temperature and a predetermined temperature set point and further varies as a function of the time at which said error exists.

5. The VAV valve assembly as recited in claim 1, further comprising a check valve means connected to said valve body for ensuring substantially unidirectional flow of said ambient air into said valve body.

6. The VAV valve assembly as recited in claim 1, wherein said solenoid valve is downstream of said coil with respect to said fluid being conveyed therethrough.

7. A system for conditioning a plurality of comfort zones comprising:

a refrigerant compressor, a condenser, an expansion device, an evaporator, and an evaporator fan all of which cooperate to function as a source of supply airflow;

a plurality of temperature sensor means with a temperature sensor means associated with each of said plurality of comfort zones and each having a selectable set point temperature;

flow sensor means associated with each of said VAV valves for generating a flow rate feedback signal indicating the actual rate of airflow through each of said VAV valves;

at least one control means generating, in response to said flow rate feedback signal and said temperature sensor means, at least one command signal;

supply air duct network means connecting each of said comfort zones to said source of supply airflow to convey said supply airflow from said source to each of said zones, said supply airflow being cooled by said evaporator to a temperature below a zone temperature as measured by at least one of said temperature sensor means;

a plurality of VAV valves with a VAV valve associated with each of said plurality of comfort zones, said VAV valves being connected to said supply air duct network means for regulating said supply airflow to each of said zones in response to said at least one command signal;

fan means and check valve means connected to at least one VAV valve for drawing ambient air into said one VAV valve and discharging said ambient air into at least one comfort zone, said one VAV valve being at a higher elevation than said one comfort zone so that said ambient air tends to be warmer than said one comfort zone;

a plurality of coils with a coil associated with each of said VAV valves, each of said coils being adapted to convey a fluid to heat said supply airflow and said ambient air to a temperature greater than said zone temperature;

a plurality of solenoid valves with a solenoid valve associated with each of said plurality of coils to control the flow of said fluid through said coil in response to at least one command signal so that for each zone and its associated VAV valve, associated temperature sensor means, associated coil, and associated solenoid valve, when a zone temperature is above said set point temperature of said associated temperature sensor means, said associated solenoid valve remains substantially closed and the opening of said associated VAV valve varies to regulate the flow rate of said airflow as a function of zone temperature, and when a zone temperature is below said set point temperature of said associated temperature sensor means, said associated solenoid valve cycles between fully open and closed in a pulse-width modulated manner with a duty cycle that varies as a function of an error between said zone temperature and said selectable set point temperature and further varies as a function of the time at which said error exists while said associated VAV valve opens to provide a substantially constant flow rate of said supply airflow, said duty cycle having a predetermined maximum closed-period to avoid uncomfortable temperature fluctuations of said airflow.

8. The system as recited in claim 7, wherein each of said solenoid valves cycles at a variable frequency that increases as said zone temperature increases.

9. The system as recited in claim 7, wherein said solenoid valves are downstream of said coils with respect to said fluid being conveyed therethrough.

10. A method of temperature conditioning a comfort zone comprising the steps of:

drawing air from said comfort zone;

cooling said air to produce temperature conditioned supply air;

conveying said supply air back to said comfort zone by way of a VAV valve;

sensing the flow rate of said supply air passing through said VAV valve;

setting a desired set point temperature of said comfort zone;

sensing a zone temperature of said comfort zone;

when said zone temperature is above said set point temperature, varying the degree of opening of said VAV valve as a function of said temperature of said comfort zone, said set point temperature, and the flow rate of said supply air; and when said zone temperature is below said set point temperature, i. positioning said VAV valve to provide a substantially constant flow rate of said supply air, ii. drawing ambient air from above said comfort zone into said VAV valve.

iii. heating said supply air and said ambient air to a temperature greater than said zone temperature using a coil conveying a heated fluid through said VAV valve, and iv. regulating the average flow rate of said fluid by open and close cycling of a solenoid valve connected to said coil with an open period of said solenoid valve relative to a closed period of said solenoid valve increasing as said zone temperature decreases, said closed period being of a predetermined maximum closed-period to avoid uncomfortable temperature fluctuations of said supply air.

11. The method as recited in claim 10, wherein the cycling of said solenoid valve is at a variable frequency.

* * * * *

UNITED STATES PATENT AND TRADEMARK OFFICE

CERTIFICATE OF CORRECTION

PATENT NO. : 4,928,750

DATED : May 29, 1990

INVENTOR(S) : Mark E. Nurczyk

It is certified that error appears in the above-identified patent and that said Letters Patent is hereby corrected as shown below:

Column 1, line 53, after "periods of" insert --high demand by reducing the cycling rate.--

Column 3, line 16, "10 a" should be --10a--.

Column 4, line 58, after "fan" insert --means--.

Signed and Sealed this

Thirteenth Day of August, 1991

*Attest:*

*Attesting Officer*

HARRY F. MANBECK, JR.

*Commissioner of Patents and Trademarks*